US006298918B1

(12) United States Patent
Franco et al.

(10) Patent No.: US 6,298,918 B1
(45) Date of Patent: Oct. 9, 2001

(54) SYSTEM FOR LIFTING PETROLEUM BY PNEUMATIC PUMPING

(75) Inventors: Zadson De Almeida Franco; Francisco Alberto Cerqueira De Oliveira, both of Aracaju (BR)

(73) Assignee: Petroleo Brasileiro S.A.-Petrobras (BR)

( * ) Notice: Subject to any disclaimer, the term of this patent is extended or adjusted under 35 U.S.C. 154(b) by 0 days.

(21) Appl. No.: 09/494,247

(22) Filed: Jan. 31, 2000

(30) Foreign Application Priority Data

Feb. 18, 1999 (BR) ..... 9900747

(51) Int. Cl.[7] ..... E21B 43/16

(52) U.S. Cl. ..... 166/372; 166/105.6; 166/163; 166/263; 166/401

(58) Field of Search ..... 166/268, 401, 166/263, 370, 372, 105.6, 163, 165, 167

(56) References Cited

U.S. PATENT DOCUMENTS 3,106,170 * 10/1963 Gray ..... 417/138
3,797,968 * 3/1974 Elfarr ..... 417/138
3,894,583 * 7/1975 Morgan ..... 166/68
3,941,511 * 3/1976 Morgan ..... 417/57
4,392,532 7/1983 Raggio .
4,427,345 * 1/1984 Blann et al. ..... 417/54
4,711,306 12/1987 Bobo .

FOREIGN PATENT DOCUMENTS 9303715-5 4/1995 (BR) .

* cited by examiner

*Primary Examiner*—David Bagnell
*Assistant Examiner*—Zakiya Walker
(74) *Attorney, Agent, or Firm*—Nixon & Vanderhye PC

(57) ABSTRACT

The invention relates to a pneumatic system for lifting petroleum, for application in wells, which may be flowing or non-flowing wells, preferably with low productivity levels or with low static pressure. The system uses cyclic pressurization and depressurization of a petroleum storage chamber located in the lower portion of the well by the injection of gas to force the fluid which has accumulated in the storage chamber to be lifted via the production column. After the storage chamber has been emptied to a certain degree, it is depressurized to allow refilling. When the storage chamber is depressurized, the gas may be diverted to the annular space between the production column and an auxiliary lift tube, where it plays a part in increasing the height of the column of fluid which it is possible to lift. A control system is responsible for the cyclic nature of the operation.

8 Claims, 6 Drawing Sheets

SYSTEM FOR LIFTING PETROLEUM BY PNEUMATIC PUMPING

FIELD OF THE INVENTION

The present invention relates to the operation of petroleum wells which require an artificial lift system. More particularly it applies to low-productivity conventional or offshore wells and offers an advantageous alternative to mechanical pumping or other known methods based on continuous gas injection.

BACKGROUND OF THE INVENTION

The various artificial lift methods which may be used for the production of petroleum in non-flowing wells or for increasing the productivity of wells in general, depending on local conditions, may present a number of drawbacks.

PRIOR ART

In non-flowing conventional wells with low productivity levels, mechanical pumping systems or gas-lift-type systems are frequently used.

Lifting the petroleum, contained in a reservoir, up to the surface is possible only if there is a minimum pressure over the petroleum at the bottom of the well. One method used to assist lifting is known as "gas lift" which comprises the injection of gas, under controlled conditions, into the annulus defined between the production column and the well casing. By means of this artificial lift method gas is continuously injected, passing through one or more valves known as gas-lift valves, from the surface to the production zone where it mixes with the oil, thereby lowering the density of the oil and facilitating its lifting to the surface.

An embodiment of this method is disclosed in U.S. Pat. No. 4,392,532, which relates to the location and the spacing of the gas-lift valves, and in U.S. Pat. No. 4,711,306, which proposes the injection of pressurized gas and liquid.

Artificial lifting by means of the gas-lift system is suitable only in wells which are draining reservoirs in which there is still a reasonable amount of static pressure such that, after injection of the propulsion gas, the pressure of the fluid at the bottom is higher than a minimum value sufficient to lift the oil/gas mixture to the surface.

Brazilian application PI 9303715-5 offers an alternative to a conventional gas-lift system. According to this application a drilled or already existing well which is blind, for example because the lower zones have been abandoned, is supplied below the perforation region. It is thus possible to obtain a column of oil over the entry of the production piping with sufficient height, after it has been gasified, to allow the lifting of the oil from the bottom of the well to the surface. The propulsion gas is brought to the production column through a second column installed in the well. Two possible embodiments are offered for achieving the object of the invention.

The mechanical systems may be of the "progressive cavity pump" (PCP) or "constant flow pump" (piston and shaft) type. Although efficient in that they allow satisfactory utilization of the oil reservoirs they exhibit, principally in wells where there is a high concentration of aggressive fluids, a high incidence of mechanical problems. Under these conditions, broken shafts, worn pump pistons, etc. are common occurrences, giving rise to the need for frequent intervention for the purposes of maintenance. Such interventions are generally fairly expensive, since they require the use of probes, and also jeopardize production targets.

Furthermore, after a certain stage in the depletion of reservoirs, gas-lift systems show a substantial reduction in efficiency.

OBJECTS OF THE INVENTION

It is a principal object of this invention to offer an improvement over the above prior art in not using moving parts, and thereby reducing maintenance costs and the need for shutting down production.

In addition, it is a further object of the invention to provide a system which, when compared with gas lift or with the system described in our Brazilian Patent Application PI 9303715-5 (now granted), will produce a greater pressure differential when the storage chamber is depressurized, thereby allowing greater utilization of the reservoir.

It is a further object of the invention to provide a system which applies equally to offshore wells, where gases are frequently present and can cause problems for mechanical systems but do not present any drawback regarding a pneumatic system. Depending on the well conditions, the efficiency of mechanical pumping will not always be guaranteed.

SUMMARY OF THE INVENTION

The invention relates to a pneumatic petroleum lift system for application in wells with low productivity levels. Basically, it consists in the cyclic pressurization and depressurization of a storage chamber, located in the lower part of the well, by means of the injection and release of gas, thereby forcing the petroleum which has accumulated there to be lifted via the production column. When the storage chamber is depressurized, the gas may be routed to the upper part of the production column where, by means of the provision of an auxiliary lift columns, the fluid lift conditions are improved. With a view to reducing the volume of gas required for operation of the system, a few adaptations are made to the geometry of the columns, creating, for example, an annular space of small volume, where said injection takes place. A control subsystem is responsible for timing the operating cycle. Depressurization of the bottom of the well, during part of the operating cycle of the system, improves the conditions of recovery of petroleum from the reservoir.

BRIEF DESCRIPTION OF THE DRAWINGS

In FIG. 3A, the bottom of the well has a "conventional" chamber for the accumulation of oil and, in FIG. 3B, the chamber is formed by using the actual well casing ("cup"-type chamber).

DETAILED DESCRIPTION OF THE INVENTION

Figure 1:
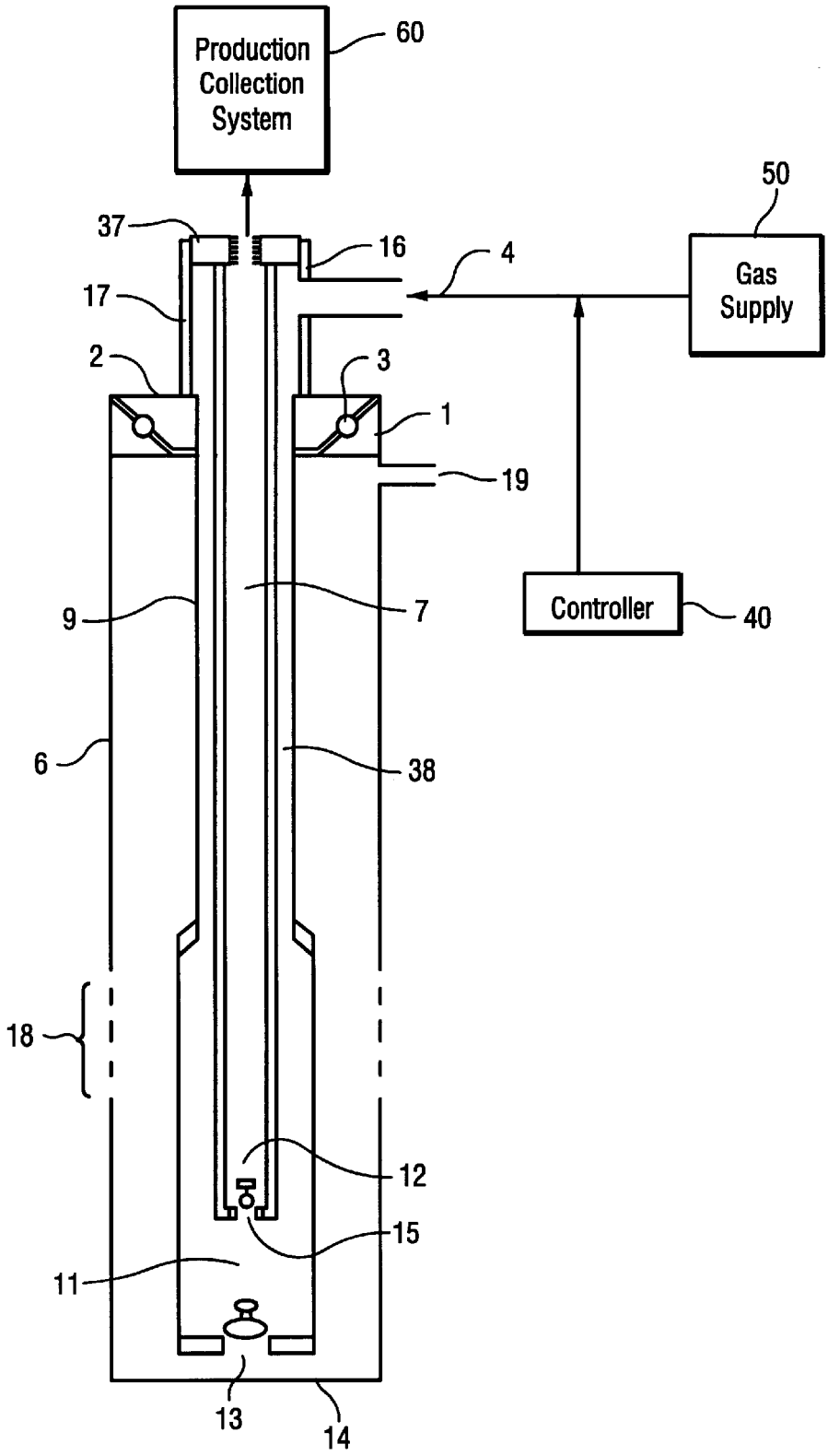
FIG. 1 shows, diagrammatically and in simplified form, the configuration of a basic embodiment of the invention, when gas is available at sufficient pressure to displace the petroleum out of the well along the entire height of the production column, by means of a single pressurization of the storage chamber, per cycle.

In order for the invention to be better understood, it will be described with reference to the Figures which accompany this specification. However, it should be pointed out that the Figures illustrate only a number of preferred embodiments of the invention and are therefore not limiting in nature. In accordance with the inventive concept, described below, it will be obvious to persons skilled in the art that it is possible to use other arrangements or complementary devices, these being included within the scope of the invention.

The invention offers an alternative to the usual systems, particularly to mechanical pumping. It is based on cyclic pressurization, by means of the injection of gas, of a storage chamber located in the lower region of the well, resulting in lifting of petroleum which has accumulated in that chamber.

When a well is being discharged by gas lift, the maximum pressure at the wellhead, at the end of displacement, should be approximately:

$$P_d = P_h + P_c - P_g, \text{ where}$$

$P_d$ is the maximum discharge pressure at the well head, $P_h$ is the hydrostatic pressure of the fluid in the well, $P_c$ is the pressure drop of the production flow system, and $P_g$ is the hydrostatic pressure of the propulsion gas column.

This condition is extreme and should occur only during starting of the well, when it is entirely full of completion fluid. During operation, the intentional gasification of the production column should maintain the discharge pressure below what is estimated above.

The volume of gas required for each cycle depends on the well discharge pressure and on the geometry of the system. This volume may be calculated, approximately, by means of the following equation:

$$V_g = ((C_a \times H_a + C_c \times H_c) \times P_i \times 460)/(T_p + 460), \text{ where:}$$

$V_g$ is the volume of gas under standard conditions of temperature and pressure (SCTP) in $m^3$, $C_a$ is the capacity of the annulus (gas pipe) in $m^3$, $C_c$ is the capacity of the storage chamber in $m^3$, $H_a$ is the length of the annulus in m, $H_c$ is the height of the storage chamber in m, $P_i$ is the operating pressure of the system in $kg/cm^2$, and $T_p$ is the mean temperature of the well in ° F.

The volume of fluid flow produced during each cycle is equal to the volume $C_c$ of the chamber.

In combination with the gasification of the production column, the use of an auxiliary lift tube, inside that column, will reduce the pressure required to operate the well, improving the yield of the process. Therefore, when the storage chamber is to be depressurized, the gas released, still under pressure, is routed to the upper region of the production column, exerting, through the said auxiliary lift tube, an additional lift action on the column of fluid. In this way, either a greater total height is achieved for the production column, for a given propulsion gas pressure, or it is possible, for the same height of production column, to use propulsion gas under less pressure.

The system of the invention has a number of favourable characteristics such as, for example, it eliminates moving parts, thereby reducing maintenance costs. Another characteristic which may be highlighted is the cyclic depressurization of the well to an extent which promotes an increase in productivity and better utilization of the reservoir.

FIG. 1 shows, diagrammatically and in simplified form, an embodiment of the invention for the case in which there is a gas-supply source available at a pressure above that required to discharge the well by means of a single pressurization of the storage chamber per cycle. This is the basic configuration of the invention. The well is shown by means of its casing (6) which has, in its lower portion, a region (18) described as "perforated" where there are passages for the entry of oil from the natural reservoir around the casing (6). An outlet (19) for fluids is shown in the upper portion of the casing (6). At its upper end, the casing has the so-called "production heads (1), which has the general shape of a circular crown. Mounted on the production head (1) is a component (2), also in the form of a circular crown and called the doughnut. Between the contact surfaces of the production head (1) and of the doughnut (2) there is generally a sealing element such as, for example, an O-ring (3). A set of connections is mounted on the doughnut (2) for interlinking and support; these may for example consist of a nipple (17), a flow Tee (16), through which gas is injected from a supply line (4), and a "sub-duplex" (37) which supports the production column (7). The doughnut (2) supports the so-called outer column (9) which in turn is provided, at its lower end, with the so-called "storage chamber" (11). The storage chamber (11) has a one-way valve (13) which allows the entry of oil but does not allow its exit. In a similar manner, the production column (7) also has a one-way valve (12). The production (7) and outer (9) columns are sized so as to minimize the volume of the annular space (38) between them, thereby reducing the volume of gas required for operating the system. The storage chamber (11) depends on the geometry of the well and is sized so as to optimize the yield of the process.

Assuming initially that the storage chamber (11) is empty, the oil which accumulates in the lower portion of the well after having passed through the region of the perforations (18) enters the storage chamber (11) through the one-way valve (13) located, for example, at its bottom (14). When the oil reaches a specific height in the storage chamber (11), gas from supply source (50) is injected through a line (40) into the well, passes through the annular space (38) between the production column (7) and the outer column (9), and arrives in the storage chamber (11). Through the effect of this pressurization, the oil which has accumulated in the storage chamber (11) passes on to the production column (7) through the one-way valve (12) provided, for example, at the bottom (15) of this column (7) and the oil is discharged into the external production collection system 60. When the oil level in the storage chamber (11) reaches a lower limit, the storage chamber is depressurized through the action of a control system (40), schematically shown in FIG. 2, to complete one operating cycle.

Figure 2:
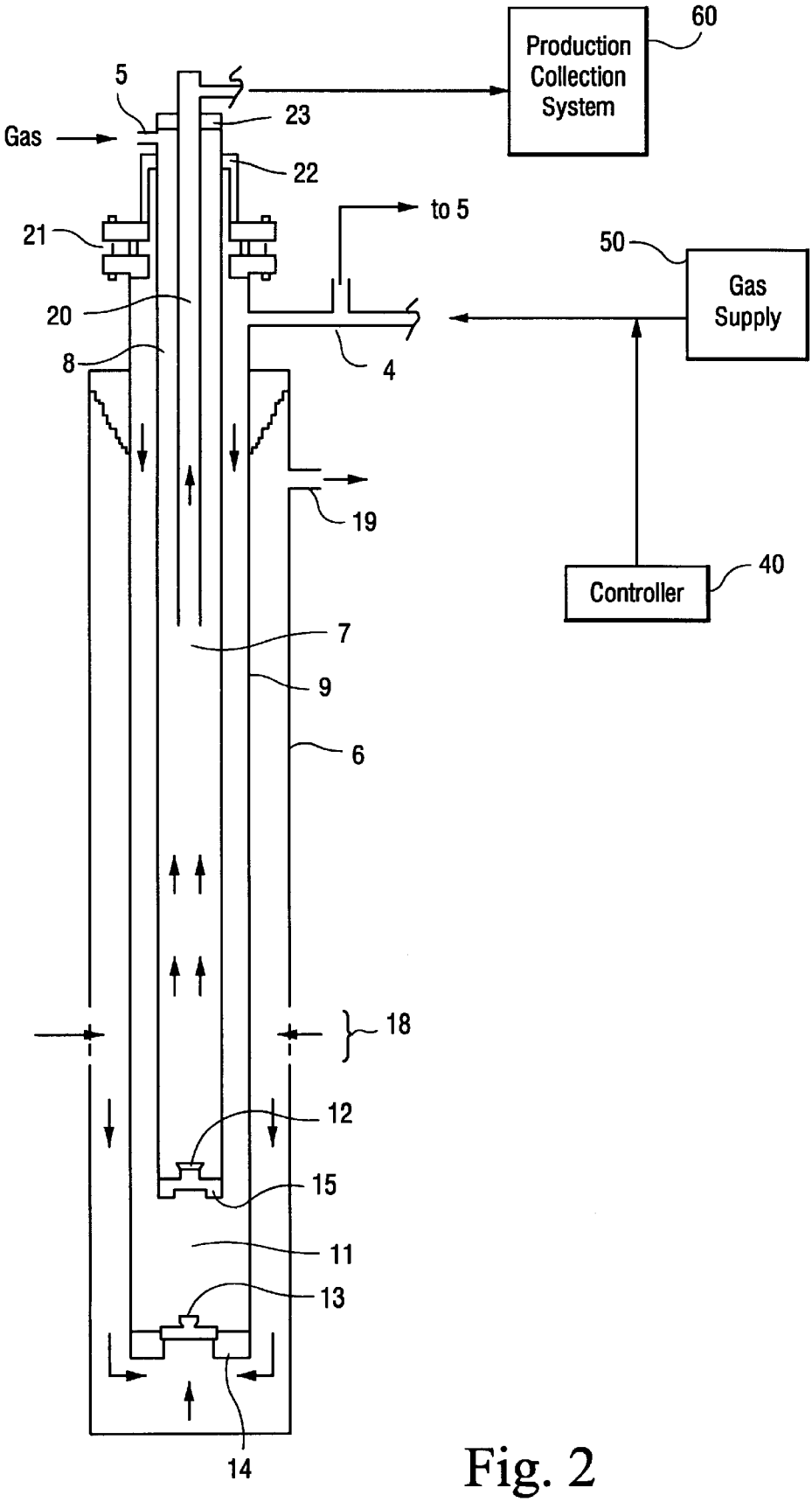
FIG. 2 shows, in a manner similar to that of FIG. 1, an embodiment of the invention equipped with means for auxiliary injection of propulsion gas and with an auxiliary lift tube inside the production column. This embodiment is indicated when there is no gas available at sufficient pressure to displace the petroleum out of the well along the entire production column, by means of a single action on the storage chamber, per cycle.

FIG. 2 shows the layout of an alternative embodiment of the invention which is suitable for equipping wells when it is desired to use a lower gas injection pressure or for equipping deeper wells when the gas injection pressure available is not sufficiently high to discharge them by means of a single pressurization of the storage chamber (11) per cycle. By means of an auxiliary injection of the gas released from the storage chamber (11), using a return pipeline (5), it is possible to operate with gas at lower pressures. Therefore provision is made, inside the production column (7), for an auxiliary lift tube (20). Up to a certain point, the deeper the lower end of this auxiliary tube (20) is introduced into the production column (7), the greater will be its effect on the total height of the column of petroleum it is possible to lift. In this manner, the well is discharged by means of the joint action of (a) the direct injection of gas (into the storage chamber (11)) and (b) the auxiliary injection of gas (into the production column (7)).

As compared with the diagram shown in FIG. 1, the principal difference is the introduction of an auxiliary lift tube (20) inside the so-called inner or production column (7) and the auxiliary injection of gas into the annular space (8) between the production column (7) and the auxiliary lift tube (20). Thus, when the storage chamber (11) is decompressed prior to being routed to the low-pressure collection system the gas is reinjected, thereby pressurizing the production column (7), lifting the column of oil via the inside of the auxiliary tube (20) and causing the oil to flow out of the well. To this end, a number of adaptations are required to the equipment at the wellhead, including a number of supplementary components to support the columns such as, for example, a flange (21) and two sub-duplexes (22, 23). The depth of the auxiliary lifting tube (20) is defined as a function of local conditions.

None of the Figures mentioned show details of the control system responsible for timing the injection intervals and gas-release intervals.

FIG. 3 shows two other layouts which are alternatives to that shown in FIG. 2 and are capable of obtaining the same objective. Both are characterized by the fact that they make use of a separate gas conveying tube (24), allowing the injection of gas directly into the storage chamber (11). In this manner, in addition to achieving a lower gas consumption, it is possible to prevent the low temperatures which occur during decompression from being able to affect the production column" n, giving rise for example to deposits of paraffin. The production column (7) and the gas conveying tube (24) are communicated with the storage chamber (11) for example by means of a double completion connector (26). In order to maximize the useful volume of the storage chamber (11) the production column (7), in its lower portion, has a length (27) of smaller diameter. This length (27) is connected to the production column (7) by means, for example, of a sub-duplex (34). This small diameter tube (27) is equipped with a one-way valve (25) to allow the entry of fluid to its inside.

Figure 3A:
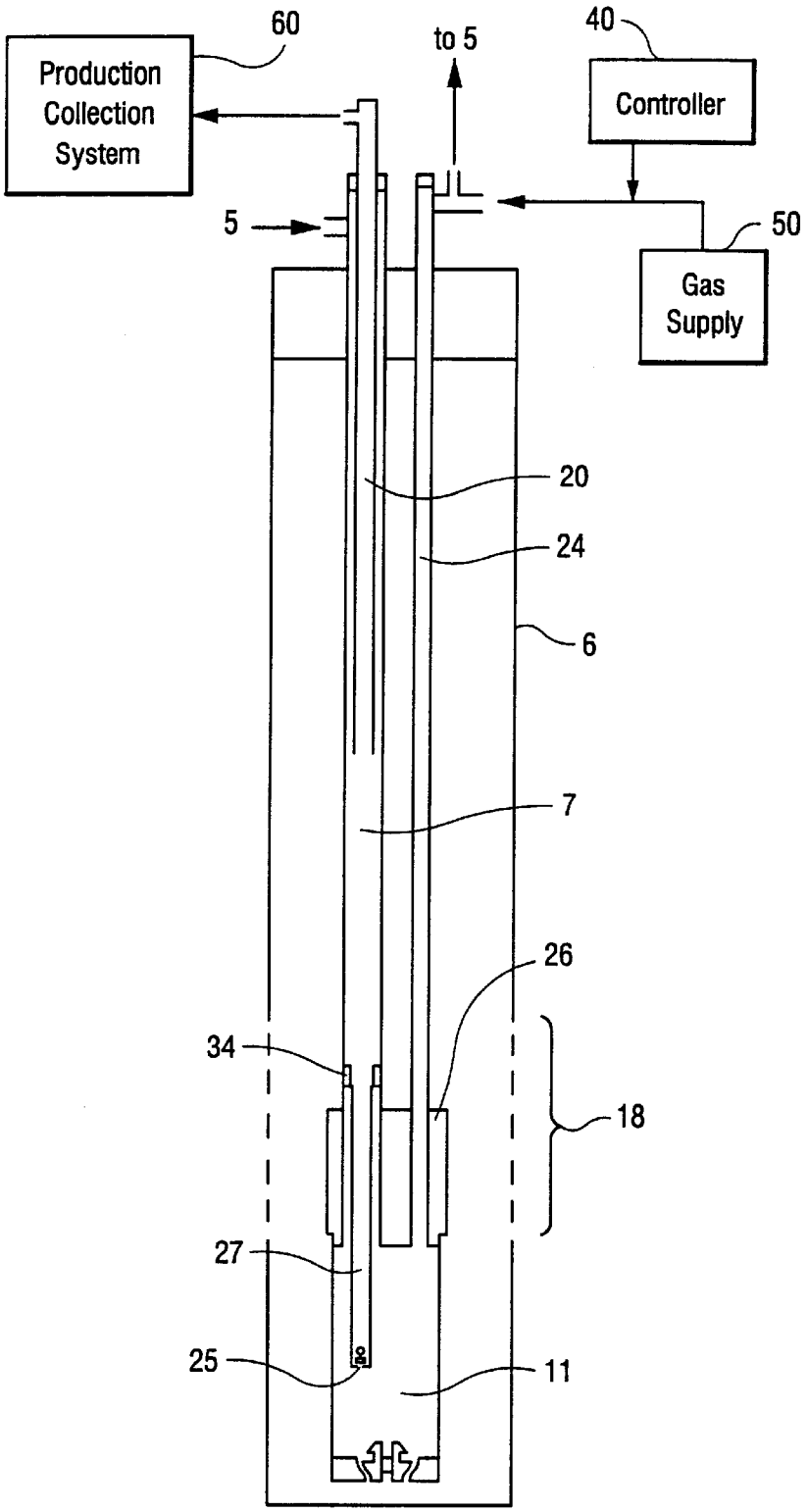
FIGS. 3A and 3B show, diagrammatically and in simplified form, two other conceptions of the invention which make use of a dedicated tube for the injection of gas.
Figure 3B:
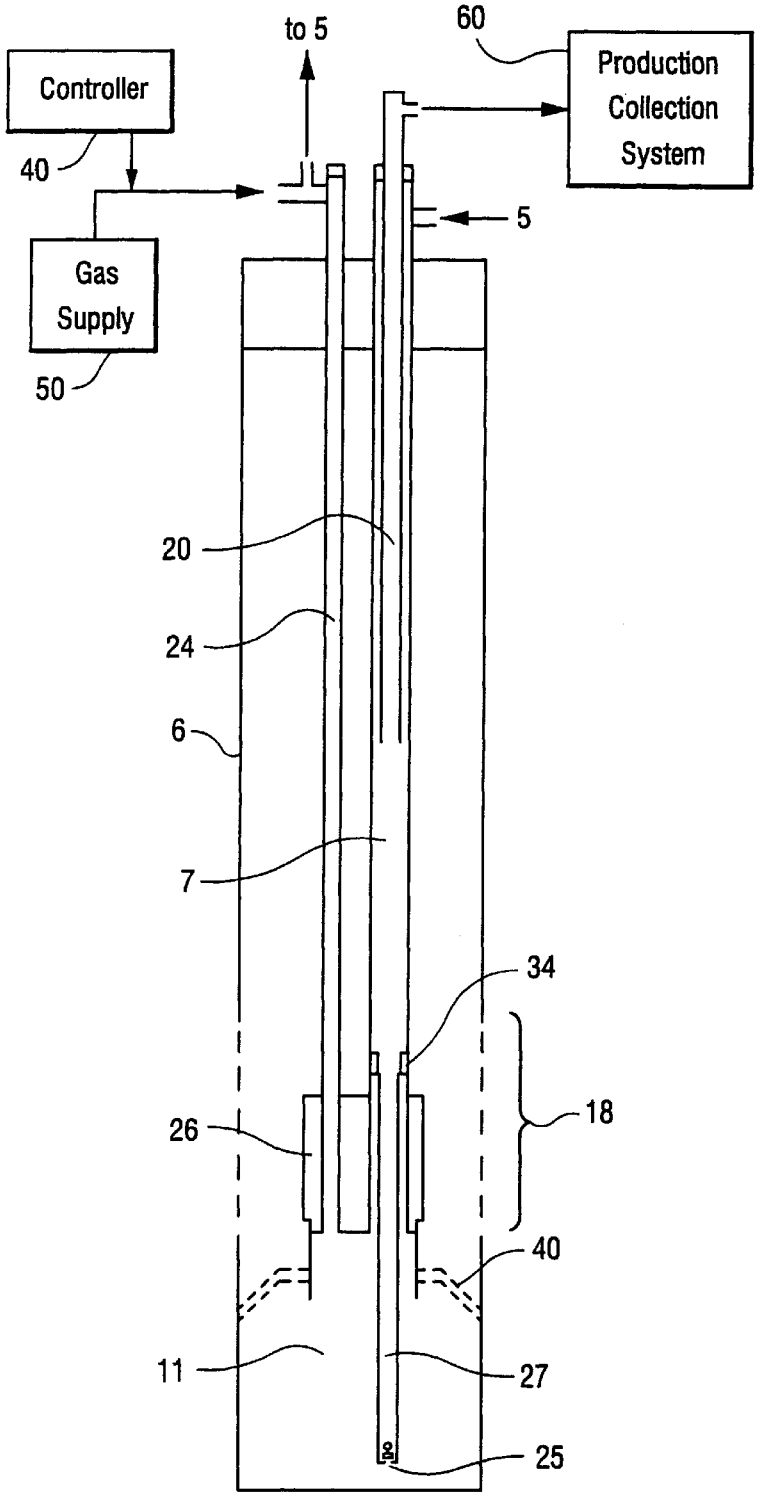

The configuration shown in FIG. 3B is different from that shown in FIG. 3A in the way the storage chamber (11) is obtained.

In FIG. 3B, the storage chamber (11) is delimited laterally by the casing (6) itself and at the bottom by the actual bottom of the well. The upper part of the chamber (11) is formed by a so-called retention cup (40) which allows the oil, coming from the productive rock, to enter the storage chamber (11) but prevents its return to the region of the perforations (18).

Figure 4:
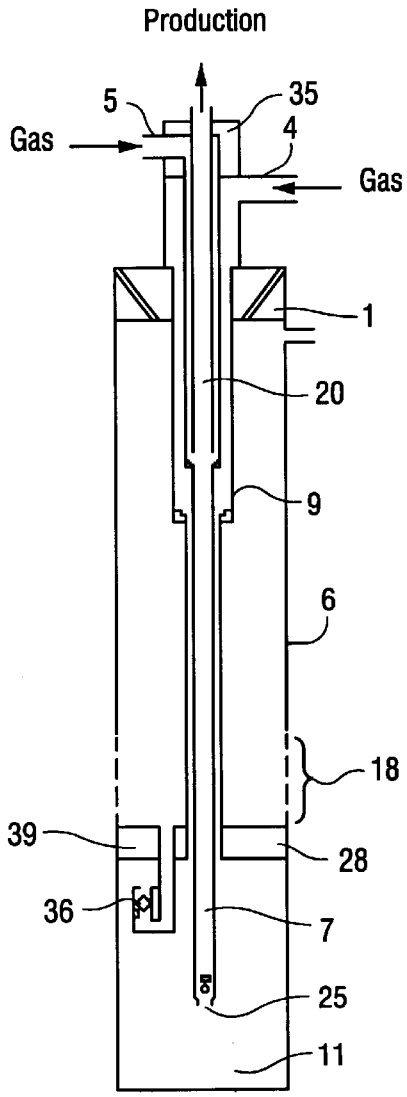
FIG. 4 shows, diagrammatically, an alternative to the "cup"-type storage chamber shown in FIG. 3B.

FIG. 4 shows an alternative embodiment of the invention, equivalent to that of FIG. 2, but one which operates with a double packer (28). This packer (28) functions as an alternative to the "cup" (40) shown in FIG. 3, allowing the use of the casing (6) of the well for the formation of the storage chamber (11). One of the orifices of the double packer (28) is used for the coupling of the outer column (9) and the other for the coupling of a tube (39) equipped with a one-way valve 436) which allows the entry of oil into the storage chamber (11) but prevents it from flowing back. Both the outer column (9) and the production column (7) are sized so as to minimize the volume of the annulus between these columns. A wellhead (35), consisting for example, of two sub-duplexes and a flow Tee, is mounted above the gas entry connection (4).

Figure 5:
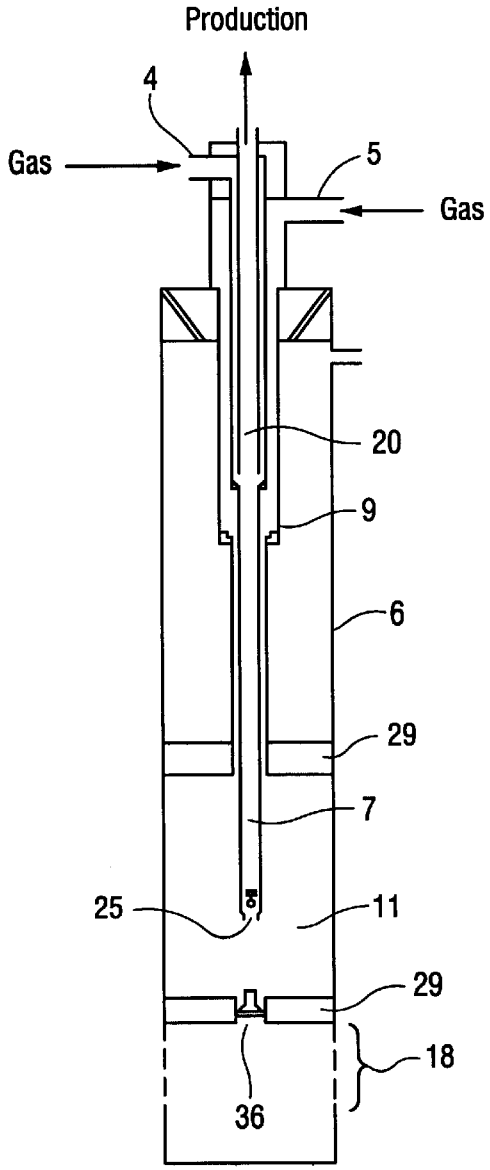
FIG. 5 shows, diagrammatically, an alternative which uses two packers to form a storage chamber above the perforations.

FIG. 5 shows an embodiment of the invention, which is an alternative to that shown in FIG. 4, when it is advantageous for the storage chamber (11) to be above the region of the perforations (18). This situation occurs, for example, when the well is equipped with a gravel pack which prevents the passage of equipment, required for the invention, to the portion of the well below the perforations (18). As regards the embodiment shown in FIG. 4, a number of modifications have been made to the way in which the storage chamber (11) is obtained. This is formed, immediately above the region of the perforations (18), by means of two packers (29) between which the chamber (11) is delimited laterally by the casing of the well. The lower packer (29) is equipped with a one-way valve (36) which allows the entry of the oil into the storage chamber (11) from below but prevents its exit. The production column (7) extends through the upper packer (29), and into the storage chamber (11) and is equipped with a one-way valve (25) which prevents the oil from the production column (7) from flowing back to the storage chamber (11).

The embodiments shown in FIGS. 3, 4 and 5 allow storage chambers (11) to be obtained with adequate capacities even when the geometry of the well does not favour this.

By way of example, possible FIGS. 6A–D show a possible sequence for lowering the equipment needed for applying the invention to a well when the pressure available in the gas compression system is below that required for discharging the oil by means of a single pressurization of the storage chamber (11) per cycle.

Figure 6D:
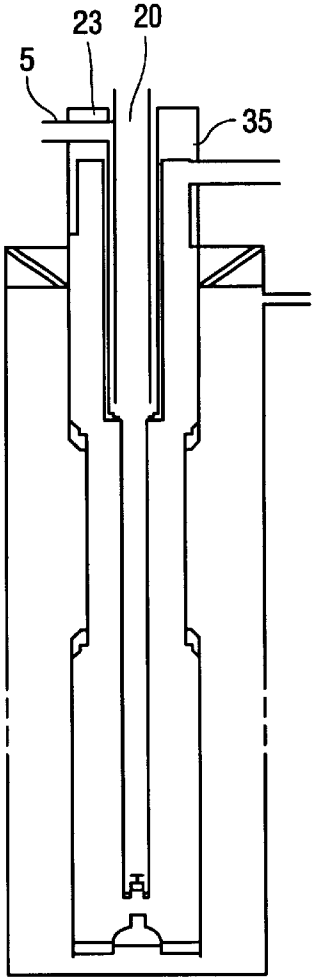
FIGS. 6A–D show, diagrammatically, one of the possible sequences for lowering the equipment needed to operate in wells equipped with an embodiment of the invention, where an auxiliary lift tube is available.
Figure 6C:
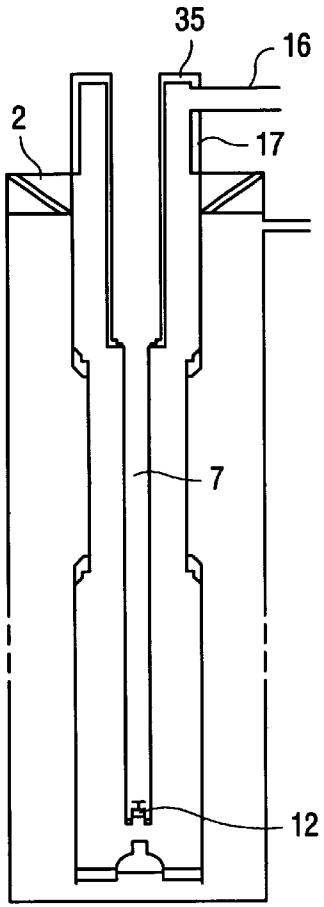
Figure 6B:
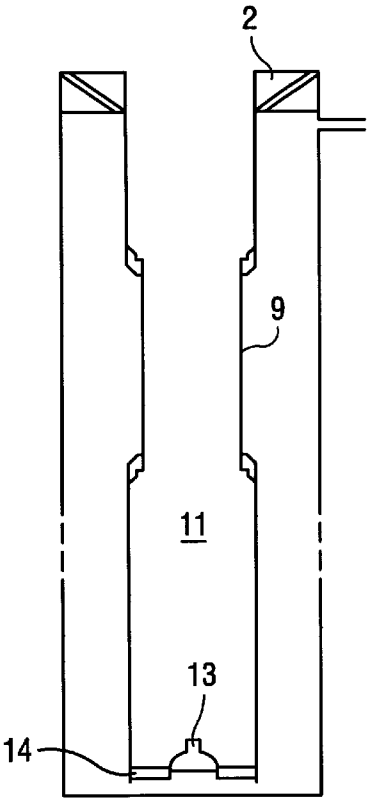
Figure 6A:
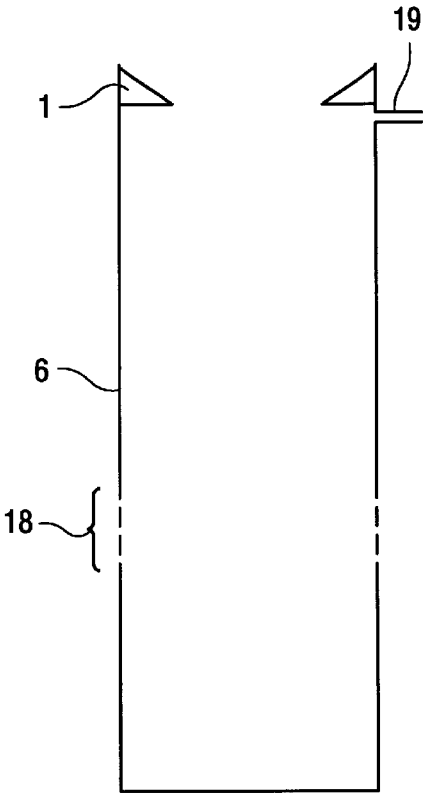

FIG. 6A shows the location of a production head (1) in a well equipped only with its casing (6) and with a fluid outlet (19) in the upper portion thereof.

FIG. 6B shows the same well, already equipped with a doughnut (2) which supports the outer column (9) having, in its intermediate portion, a length with a smaller diameter in order to reduce the annular space, the lower portion returning to the original diameter suitable for the formation of a storage chamber (11). At the lower end, the outer column (9) is equipped with a bottom (14) and with a one-way valve (13).

In FIG. 6C, it is possible to see the production column (7) introduced into the outer column (9). A nipple (17), to which are coupled a flow Tee (16) for the injection of gas and a sub-duplex (35) for supporting the production column (7), is mounted on the doughnut (2). This column (7) is equipped with a one-way valve (12).

Finally, in FIG. 6D it is possible to see the final configuration, obtained after the mounting, on the sub-duplex (35), of a flow Tee (5) to allow the auxiliary injection of gas, and on top of this another sub-duplex (23) to support the auxiliary oil lift tube (20).

The invention functions cyclically. Assuming that the equipment has been assembled in accordance with FIG. 6D, and assuming that the oil level in the storage chamber (11) has reached a predetermined height, a first stage is characterized by the pressurization of the storage chamber (11) using gas injected into the annular space between the production column (7) and outer column (9). The objective of this pressurization is to displace the oil from the storage chamber (11) to the production column (7). In a second stage, when the oil level in the storage chamber (11) reaches a specific minimum value, the chamber becomes decompressed, in that its pressure is reduced to the lowest possible value. In this situation, the pressure at the wellhead should be equal to atmospheric pressure or equal to the pressure of the collection system 60 to which the gas is discharged. The collection system, in turn, should have the lowest possible pressure for better process efficiency.

When the pressure of the gas source is insufficient to discharge the well by means of the pressurization of the storage chamber (11) alone, as shown in FIG. 6, or to optimize the process, the decompression may take place in two stages. Initially, the gas is routed to the annular space between the production tube (7) and the auxiliary lift tube (20). After lifting of the oil via the auxiliary tube (20), the storage chamber (11) being emptied, the gas is discharged into the low-pressure gas collection system. The next stage, to complete the operating cycle of the system, consists in the re-supplying of the storage chamber (11) with fluid from the reservoir. The time required for this re-supplying is a function of the productivity level (PL) of the well.

The invention makes use of a conventional control system based on timer elements and valves, which may be adjusted empirically, for example in accordance with the conditions peculiar to the well.

It is desirable for there to be a gas compression or processing plant nearby for supplying the propulsion gas.

As regards the gas used in the system of this invention, the part which is mixed with the liquid phase may be recovered in separation plants which are normally available. In general, a system equipped with a closed circuit for the circulation of the gas required for pneumatic pumping is used. The low-pressure gas network of the field itself is frequently used for routing the gas, after an operating cycle, to a compressor unit, where it will be reconditioned before returning to the process.

What is claimed is:

1. A system for lifting petroleum by pneumatic pumping for increasing the production of petroleum wells having well casings and well bottoms and improving the level of utilization of the oil in the reservoir, characterized in that the apparatus comprises:

first and second columns along the depth of the well, said first column having a diameter greater than that of the second column; said first column surrounding the second column, and said second column serving as production column for the well; said first and second columns delimiting between them an annular space where pressurized gas is injected; said first column having upper and lower portions with said lower portion of larger diameter than said upper portion and forming a storage chamber for fluid, a one-way valve to said storage chamber;

a one-way valve to said second column;

means for supporting said first and second columns;

first gas injection means for the injection of gas to said annular space;

a control system operating to control said gas injection;

a gas supply source, and inside the production column:

an auxiliary lift tube, means for supporting the auxiliary lift tube, and second gas injection means for auxiliary injection of gas into the annular space between said second column and said auxiliary lift tube.

2. A system for lifting petroleum by pneumatic pumping according to claim 1, characterized in that it is constructed to function cyclically, each cycle comprising the stages of filling of the storage chamber with petroleum, pressurization of the storage chamber with gas, drainage of the storage chamber and depressurization of the storage chamber; and in that said control stem is operative to time said stages.

3. A system for lifting petroleum by pneumatic pumping according to claim 1, characterized by a tube connecting said first gas injection means to said storage chamber; by a double completion connector connecting the production column and said gas-injection tube to the storage chamber; and by said second column having upper and lower portions with said lower portion of smaller diameter than said upper portion.

4. A system for lifting petroleum by pneumatic pumping according to claim 3, characterized in that said storage chamber is constructed so as to use (i) the well casing as lateral boundary, (ii) the bottom of the well as a lower boundary and (iii) as upper boundary, an approximately frustoconical surface equipped with means for allowing the entry of fluid and for preventing the exit of fluid.

5. A system for lifting petroleum by pneumatic pumping according to claim 1, characterized in that the storage chamber is delimited laterally by said well casing, at the bottom by the well bottom and, at the top, by a first packer; in that said first packer includes a one-way valve; and in that said first and second columns each have lower parts with reduced diameters.

6. A system for lifting petroleum by pneumatic pumping according to claim 5, characterized in that the well casing includes means defining perforations; in that the storage chamber is located above the region of said perforations and is delimited laterally by the well casing and at the top and at the bottom by second and third packers; in that said second packer is above said third packer and is arranged around said second column serving as the production column; and in that said lower packer is equipped with a one-way valve.

7. A system for lifting petroleum by pneumatic pumping according to claims 5 characterized in that it is constructed to function cyclically, each cycle comprising the stages of filling of the storage chamber with petroleum, pressurization of the storage chamber with gas, drainage of the storage chamber, pressurization of the annular space between the second column and said auxiliary lift tube, and depressurization of said annular space and of the storage chamber; and in that said control system is effective to time said stages.

8. A system for lifting petroleum by pneumatic pumping according to claim 1, characterized in that it is constructed to function cyclically, each cycle comprising the stages of filling of the storage chamber with petroleum, pressurization of the, storage chamber with gas, drainage of the storage chamber, pressurization of the annular space between the second column and said auxiliary lift tube, and depressurization of said annular space and of the storage chamber; and in that said control system is effective to time said stages.

* * * * *